US005711718A

United States Patent [19]

Mueller

[11] Patent Number: 5,711,718

[45] Date of Patent: Jan. 27, 1998

[54] GOLF SWING IMPROVEMENT DEVICE

[76] Inventor: Daniel Mueller, 42714 N. Murphy Ave., Queen Creek, Ariz. 85242

[21] Appl. No.: 791,662

[22] Filed: Jan. 30, 1997

[51] Int. Cl.[6] ..... A63B 69/36

[52] U.S. Cl. ..... 473/234

[58] Field of Search ..... 473/232, 233, 473/234

[56] References Cited

U.S. PATENT DOCUMENTS

| | | | |
|---|---|---|---|
| 2,088,343 | 7/1937 | Radley | 473/233 |
| 2,135,648 | 11/1938 | Stumpf | 473/233 |
| 2,203,893 | 6/1940 | Chapman | 473/233 |
| 2,950,115 | 8/1960 | Hurdzan | 473/234 |
| 4,027,886 | 6/1977 | Katsube | 473/234 |

*Primary Examiner*—George J. Marlo

[57] ABSTRACT

A new Golf Swing Improvement Device for helping a golfer determine the impact point of his or her golf swing. The inventive device includes a cylindrical sleeve member having a circular bore therethrough adapted to receive a shaft of a golf club, and a Plurality of spring-biased shaft contact members provided within the circular bore for contacting and hugging the shaft of the golf club, whereby the cylindrical sleeve member is free to slidably travel along the length of the shaft of the golf club during a swing thereof. The shaft contact members compensate for the taper in the shaft of the golf club and allow the cylindrical sleeve member to slidably travel concentrically along the shaft of the golf club between the handle and the head.

20 Claims, 6 Drawing Sheets

GOLF SWING IMPROVEMENT DEVICE

BACKGROUND OF THE INVENTION

1. Field of the Invention

The present invention relates to golf club attachments and more particularly pertains to a new Golf Swing Improvement Device for helping a golfer determine the impact point of his or her golf swing.

2. Description of the Prior Art

The use of golf club attachments is known in the prior art. More specifically, golf club attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf club attachments include U.S. Pat. Nos. 4,588,191; 4,213,614; D290,150; D247,919; 5,405,139 and 4,984,801.

While these devices fulfill their respective, particular objectives and requirements, the aforementioned patents do not disclose a new Golf Swing Improvement Device. The inventive device includes a cylindrical sleeve member having a circular bore therethrough adapted to receive a shaft of a golf club, and a shaft contact means provided within the circular bore for contacting and hugging the shaft of the golf club, whereby the cylindrical sleeve member is free to slidably travel along the length of the shaft of the golf club during a swing thereof.

In these respects, the Golf Swing Improvement Device according to the present invention substantially departs from the conventional concepts and designs of the prior art, and in so doing provides an apparatus primarily developed for the purpose of helping a golfer determine the impact point of his or her golf swing.

SUMMARY OF THE INVENTION

In view of the foregoing disadvantages inherent in the known types of golf club attachments now present in the prior art, the present invention provides a new Golf Swing Improvement Device construction wherein the same can be utilized for helping a golfer determine the impact point of his or her golf swing.

The general purpose of the present invention, which will be described subsequently in greater detail, is to provide a new Golf Swing Improvement Device apparatus and method which has many of the advantages of the golf club attachments mentioned heretofore and many novel features that result in a new Golf Swing Improvement Device which is not anticipated, rendered obvious, suggested, or even implied by any of the prior art golf club attachments, either alone or in any combination thereof.

To attain this, the present invention generally comprises a cylindrical sleeve member having a circular bore therethrough adapted to receive a shaft of a golf club, and a shaft contact means provided within the circular bore for contacting and hugging the shaft of the golf club, whereby the cylindrical sleeve member is free to slidably travel along the length of the shaft of the golf club during a swing thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Golf Swing Improvement Device apparatus and method which has many of the advantages of the golf club attachments mentioned heretofore and many novel features that result in a new Golf Swing Improvement Device which is not anticipated, rendered obvious, suggested, or even implied by any of the prior art golf club attachments, either alone or in any combination thereof.

It is another object of the present invention to provide a new Golf Swing Improvement Device which may be easily and efficiently manufactured and marketed.

It is a further object of the present invention to provide a new Golf Swing Improvement Device which is of a durable and reliable construction.

An even further object of the present invention is to provide a new Golf Swing Improvement Device which is susceptible of a low cost of manufacture with regard to both materials and labor, and which accordingly is then susceptible of low prices of sale to the consuming public, thereby making such Golf Swing Improvement Device economically available to the buying public.

Still yet another object of the present invention is to provide a new Golf Swing Improvement Device which provides in the apparatuses and methods of the prior art some of the advantages thereof, while simultaneously overcoming some of the disadvantages normally associated therewith.

Still another object of the present invention is to provide a new Golf Swing Improvement Device for helping a golfer determine the impact point of his or her golf swing.

Yet another object of the present invention is to provide a new Golf Swing Improvement Device which includes a cylindrical sleeve member having a circular bore therethrough adapted to receive a shaft of a golf club, and a shaft contact means provided within the circular bore for contacting and hugging the shaft of the golf club, whereby the cylindrical sleeve member is free to slidably travel along the length of the shaft of the golf club during a swing thereof.

Still yet another object of the present invention is to provide a new Golf Swing Improvement Device that can be used by a golfer to help the golfer learn how to drive a golf ball correctly with maximum power.

Even still another object of the present invention is to provide a new Golf Swing Improvement Device that can be used by a golfer to improve the consistency and accuracy of his or her golf drives.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top view of the first embodiment of the present invention from the perspective of line 2—2 of FIG. 1.

FIG. 3 is a cross sectional view of the first embodiment of the present invention taken along line 3—3 of FIG. 2.

FIG. 4 is a cross sectional view of the first embodiment of the present invention taken along line 4—4 of FIG. 2.

FIG. 5 is a top view of the second embodiment of the present invention.

FIG. 6 is a side view of the second embodiment of the present invention.

FIG. 7 is a cross sectional view of the second embodiment of the present invention taken along line 7—7 of FIG. 5.

FIG. 8 is a cross sectional view of the second embodiment of the present invention taken along line 8—8 of FIG. 6.

FIG. 9 is a top view of the impact member of the present invention from the perspective of line 9—9 of FIG. 1.

FIG. 10 is a cross sectional view of the impact member of the present invention taken along line 10—10 of FIG. 9.

DESCRIPTION OF THE PREFERRED EMBODIMENT

Figure 1:
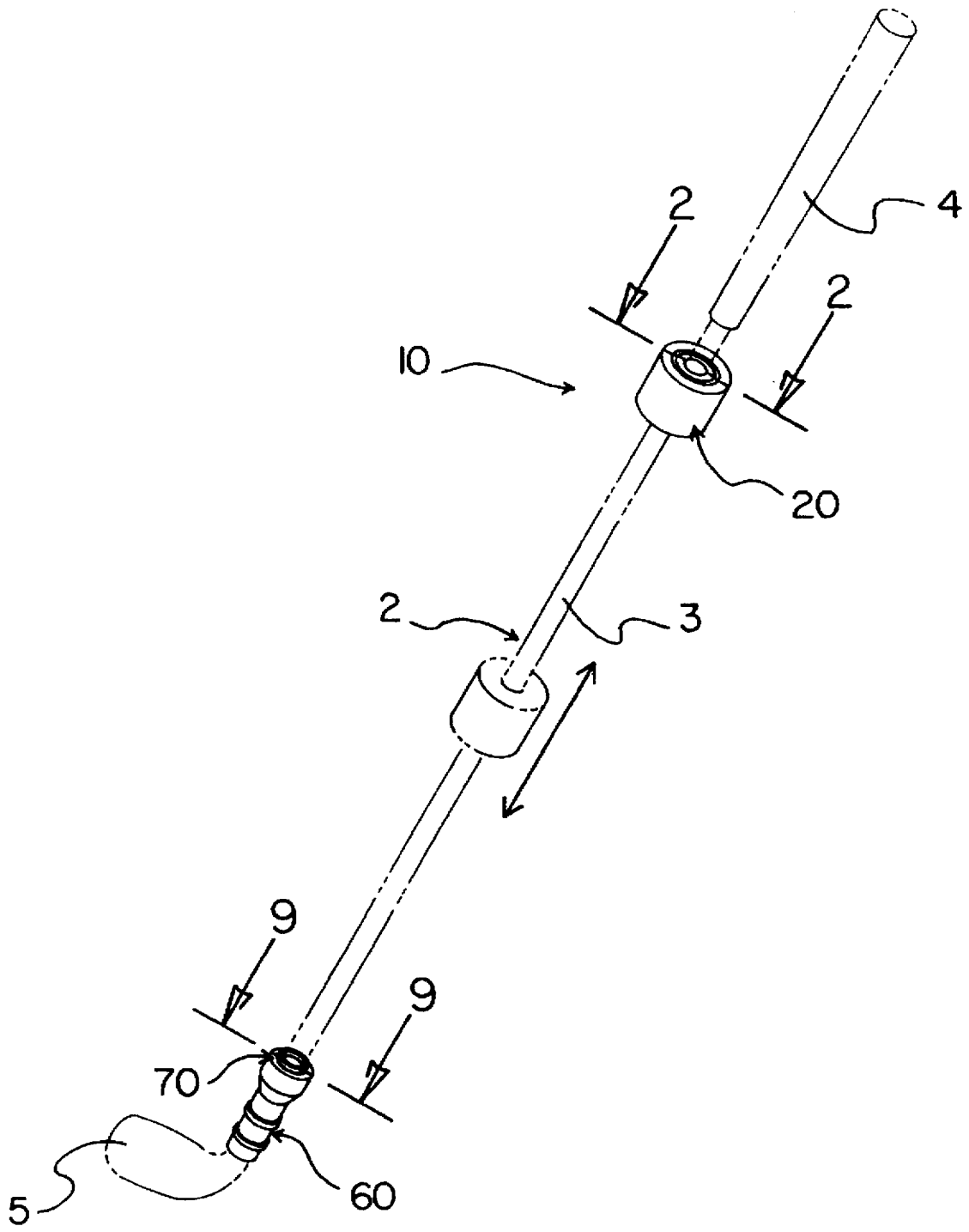
FIG. 1 is an illustration of a new Golf Swing Improvement Device installed on a golf club according to the present invention.

With reference now to the drawings, and in particular to FIGS. 1 through 11 thereof, a new Golf Swing Improvement Device embodying the principles and concepts of the present invention and generally designated by the reference numeral 10 will be described.

More specifically, it will be noted that the Golf Swing Improvement Device 10 comprises a cylindrical sleeve member 20 having a circular bore 20*c* therethrough adapted to receive a shaft 3 of a golf club 2, and a shaft contact means 40 provided within the circular bore 20*c* for contacting and hugging the shaft 3 of the golf club 2, whereby the cylindrical sleeve member 20 is free to slidably travel along the length of the shaft 3 of the golf club 2 during a swing thereof.

As best illustrated in FIG. 1, it can be shown that the Golf Swing Improvement Device 10 is intended for use on a golf club 2 having a straight or tapered shaft 3 with a handle 4 at one end of the shaft 3 and a head 5 at an opposite end.

Figure 2:
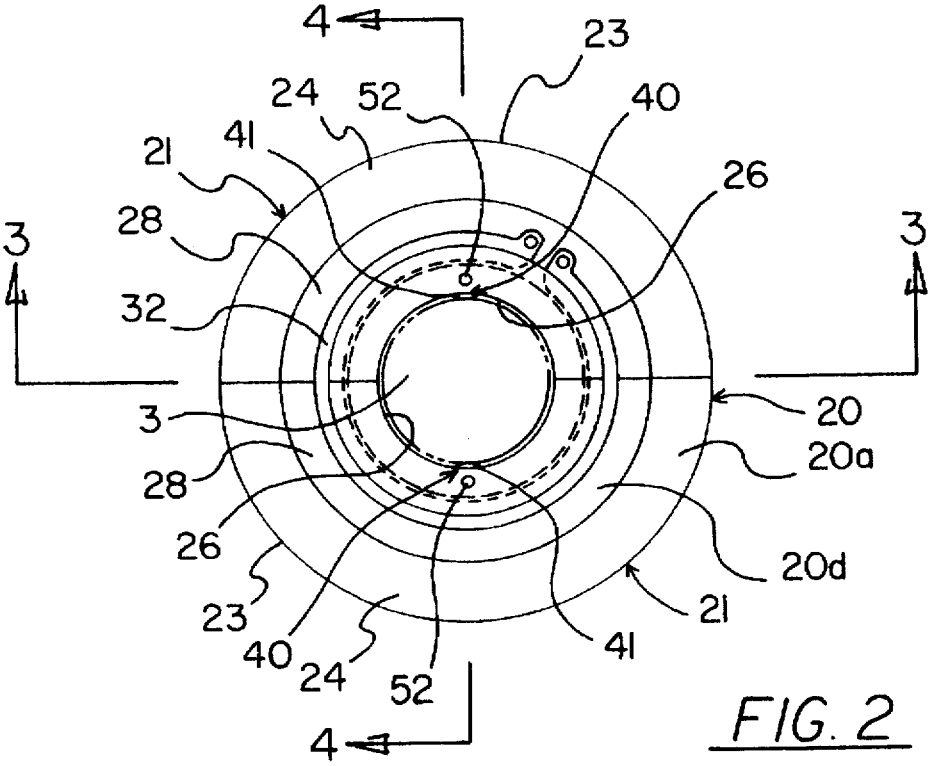
FIGS. 2 through 4 are directed to a first embodiment of the present invention.
Figure 3:
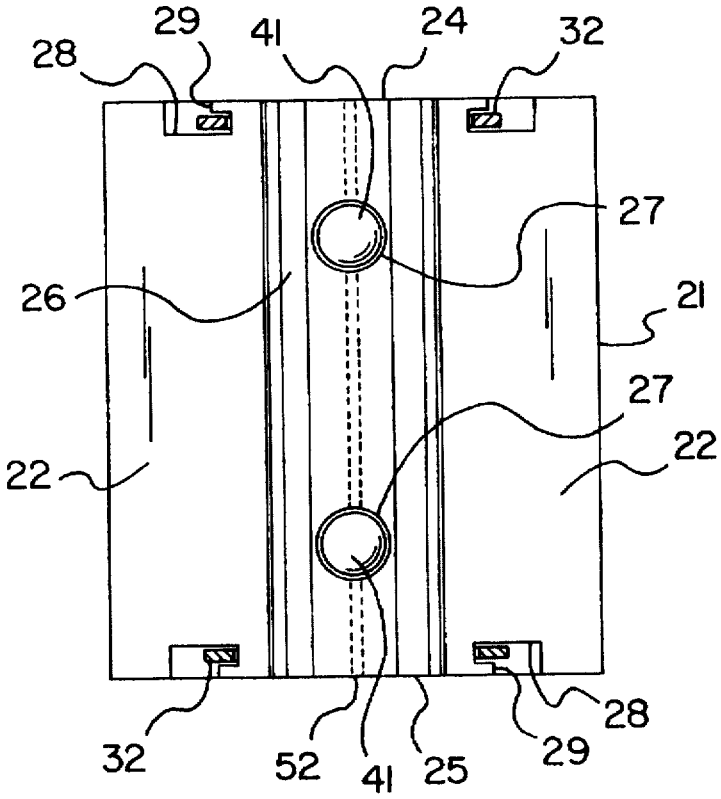
Figure 4:
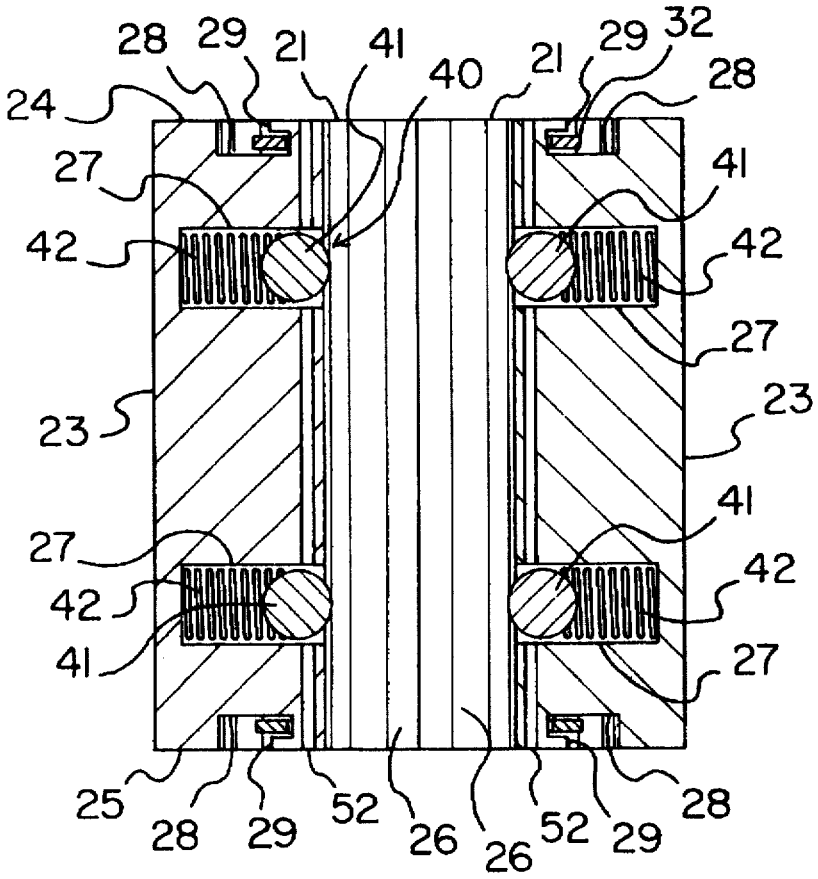
Figure 11:
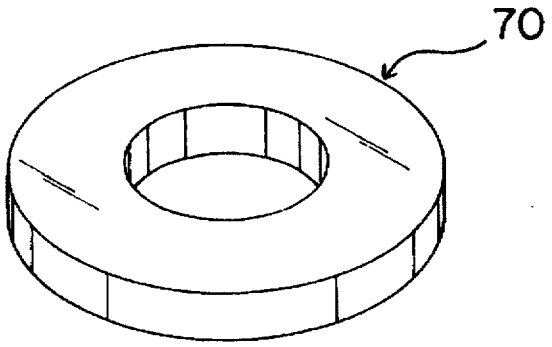
FIG. 11 is an illustration of an elastomer ring of the present invention.
Figure 5:
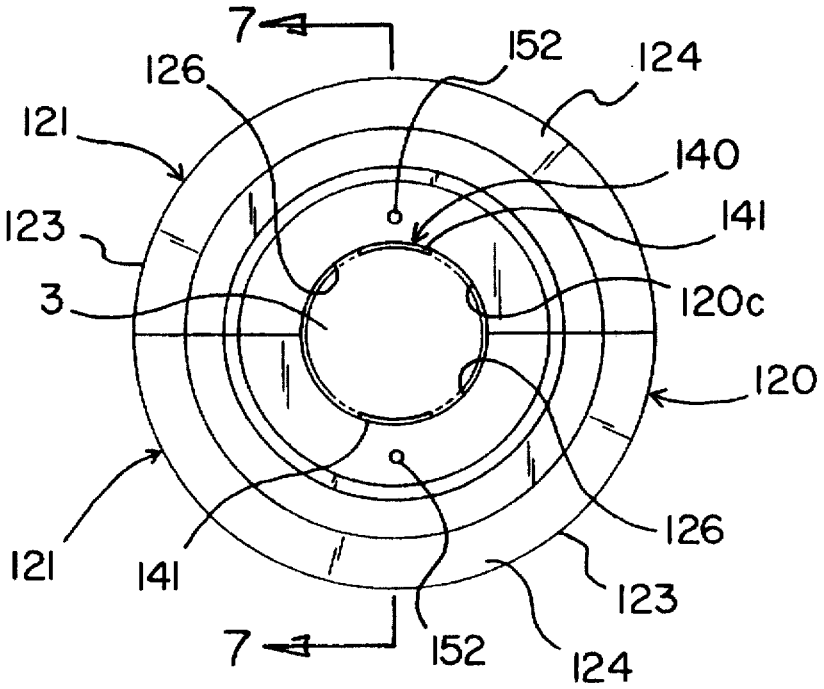
FIGS. 5 through 8 are directed to a second embodiment of the present invention.
Figure 6:
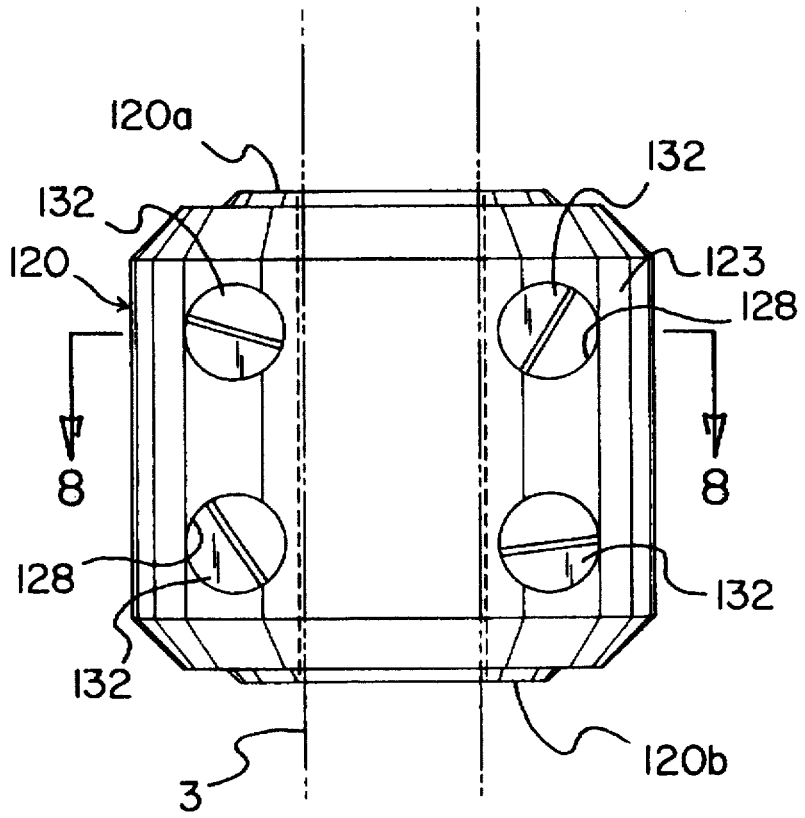
Figure 7:
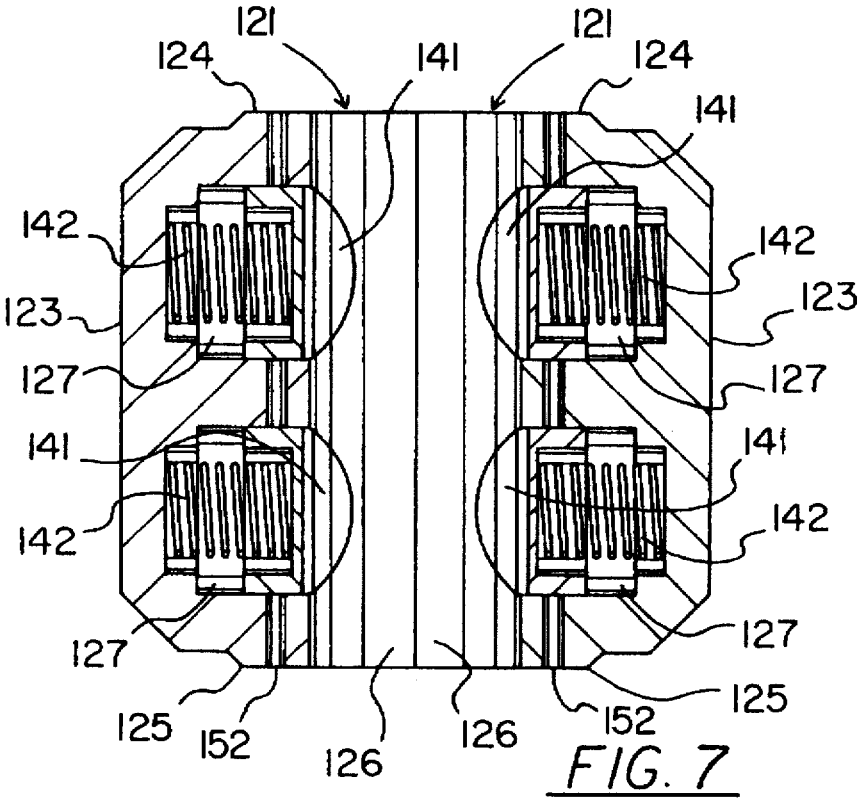
Figure 8:
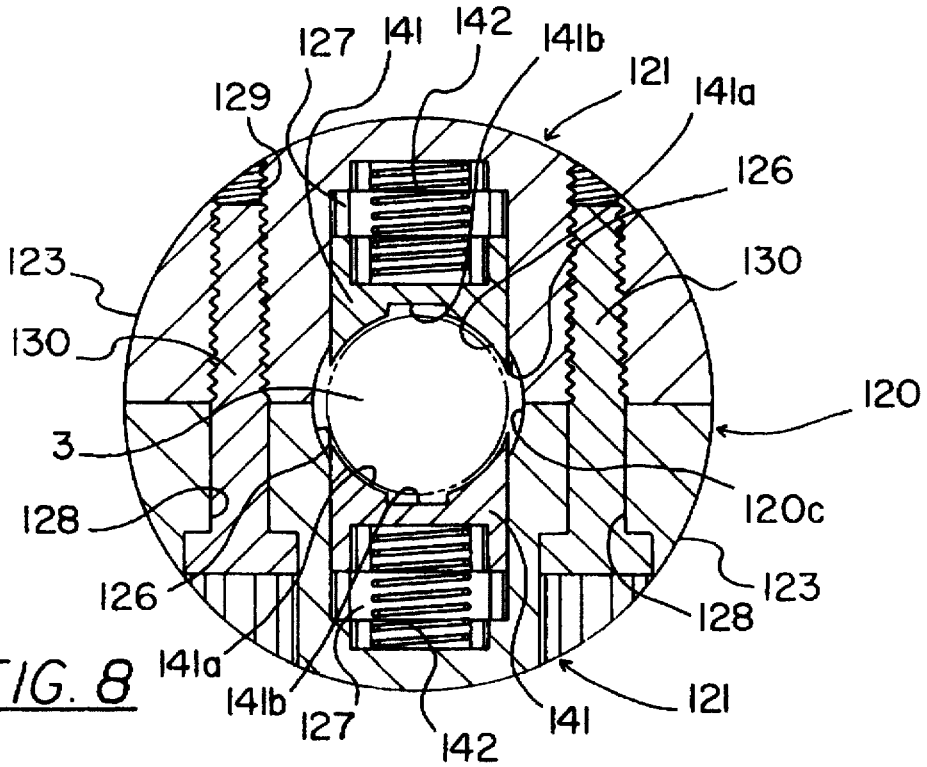
Figure 9:
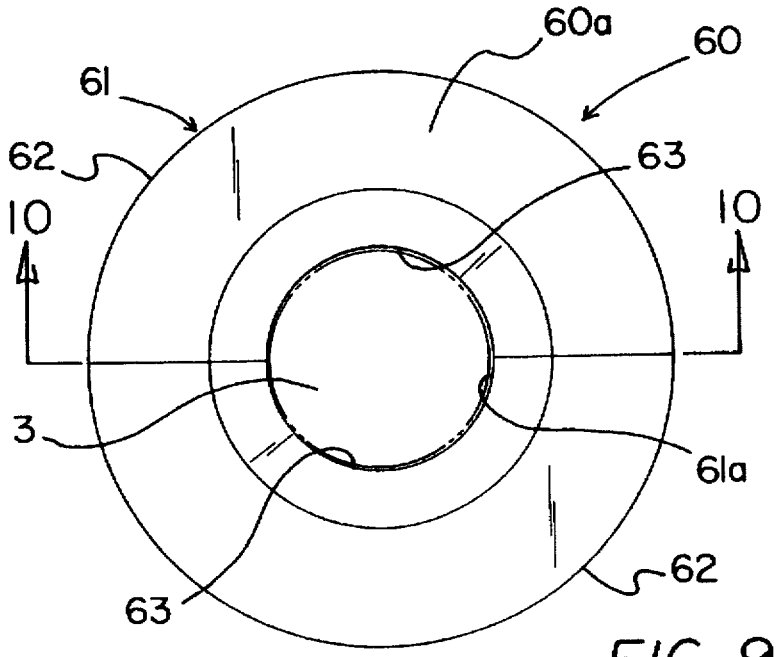
FIGS. 9 and 10 are directed to an impact member of the present invention.
Figure 10:
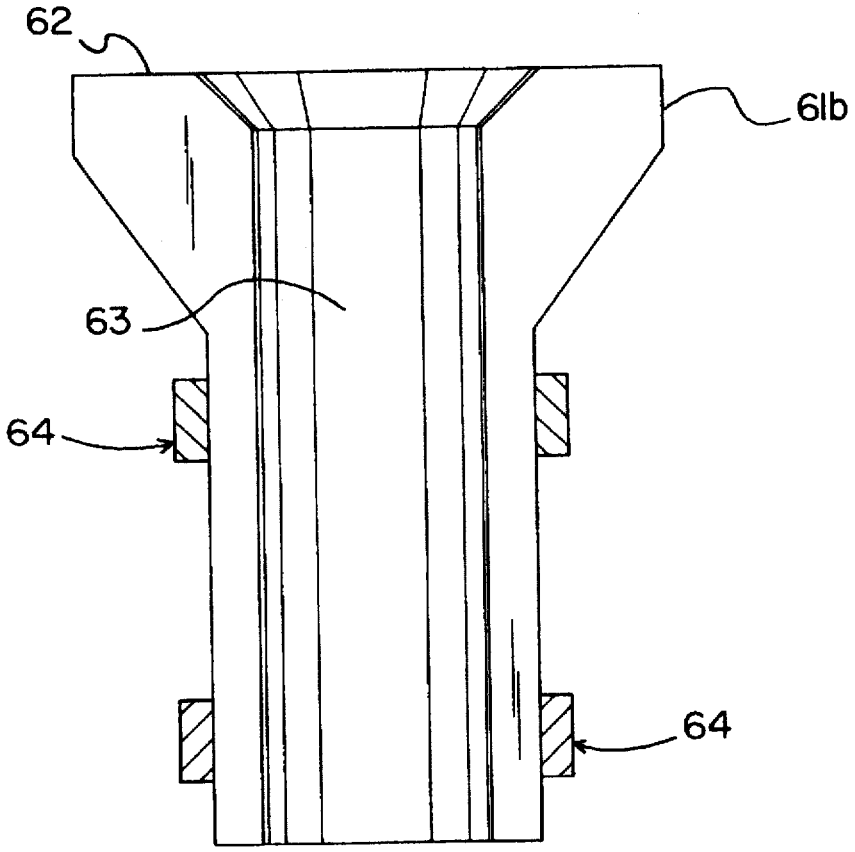

As best illustrated in FIGS. 2 through 4, it can be shown that the cylindrical sleeve member 20 has a top surface 20*a*, a bottom surface 20*b*, and a circular bore therebetween 20*c*. The cylindrical sleeve member 20 is preferably formed of aluminum. The cylindrical sleeve member 20 comprises a pair of semi-cylindrical members 21 each having a planar surface 22, a convex surface 23, a semi-circular top surface 24, and a semi-circular bottom surface 25. The planar surface 22 has a semi-circular groove 26 therein extending from the semi-circular top surface 24 to the semi-circular bottom surface 25. The semi-circular groove 26 has a pair of axially aligned cavities 27 therein. The semi-circular top surface 24 and the semi-circular bottom surface 25 each have a semi-annular groove 26 therein. The semi-annular groove 26 is undercut to form a semi-annular lip 29. The pair of semi-cylindrical members 21 are mateably joined to form a cylindrical sleeve member 20 having a circular bore 20*c* therethrough and form an annular groove 20*d* with an annular lip 20*e* in each of the top surface 20*a* and the bottom surface 20*b*.

A fastening means 30 is provided for joining the pair of semi-cylindrical members 21 to form the cylindrical sleeve member 20. The fastening means 30 joins the pair of semi-cylindrical members 21 around the shaft 3 of the golf club 2 whereby the cylindrical sleeve member 20 is slidably mounted on the shaft 3 of the golf club 2. The fastening means 30 comprises a snap ring 32 fitted within the annular groove 20*d* and under the annular lip 20*e* of each of the top surface 20*a* and the bottom surface 20*b* of the cylindrical sleeve member 20.

The shaft contact means 40 comprises a ball bearing 41 protruding from each of the pair of axially aligned cavities 27 into the circular bore 20*c* of the cylindrical sleeve member 20. The ball bearing 41 may be formed of either steel or nylon. A projection spring 42 is located within each of the pair of axially aligned cavities 27 and is positioned behind the ball bearing 41 whereby the projection spring 42 presses the ball bearing 41 against the shaft 3 of the golf club 2. As such, the cylindrical sleeve member 20 is free to slidably travel along the length of the shaft 3 of the golf club 2 during a swing thereof.

A ball bearing retention means 50 is provided for retaining the ball bearing 41 within each of the pair of axially aligned cavities 27 while joining the pair of semi-cylindrical members 21 around the shaft 3 of the golf club 2. The ball bearing retention means 50 comprises a pin (not shown) inserted through a pin hole 52 provided in each of the pair of semi-cylindrical members 21, whereby the pin compresses the ball bearing 41 into each of the pair of axially aligned cavities 27. The pin hole 52 extends from the semi-circular top surface 24 of each of the pair of semi-cylindrical members 21 to the semi-circular bottom surface 25, is provided adjacent the semi-circular groove 26 provided in each of the pair of semi-cylindrical members 21, and is axially aligned and contiguous with the pair of axially aligned cavities 27.

A second embodiment of the present invention is illustrated in FIGS. 5 through 8. The second embodiment is similar to the first embodiment in that the second embodiment comprises a cylindrical sleeve member 120 having a circular bore 120*c* therethrough adapted to receive a shaft 3 of a golf club 2, and a shaft contact means 140 provided within the circular bore 120*c* for contacting and hugging the shaft 3 of the golf club 2, whereby the cylindrical sleeve member 120 is free to slidably travel along the length of the shaft 3 of the golf club 2 during a swing thereof.

The cylindrical sleeve member 120 has a top surface 120*a*, a bottom surface 120*b*, and a circular bore 120*c* therebetween. The cylindrical sleeve member 120 comprises a pair of semi-cylindrical members 121 each having a planar surface 122, a convex surface 123, a semi-circular top surface 124, and a semi-circular bottom surface 125. The planar surface 122 has a semi-circular groove 126 therein extending from the semi-circular top surface 124 to the semi-circular bottom surface 125. The semi-circular groove 126 has a pair of axially aligned cavities therein 127. A first of the pair of semi-cylindrical members 121 has a plurality of holes 128 therethrough extending from the convex surface 123 to the planar surface 122. A second of the pair of semi-cylindrical members 121 has a plurality of threaded holes 129 therethrough extending from the planar surface 122 to the convex surface 123. The pair of semi-cylindrical members 121 are mateably joined to form a cylindrical sleeve member 120 having a circular bore 120*c* therethrough such that one each of the plurality of holes 128 is aligned with one each of the plurality of threaded holes 129.

A fastening means 130 is provided for joining the pair of semi-cylindrical members 121 to form the cylindrical sleeve member 120. The fastening means 130 joins the pair of semi-cylindrical members 121 around the shaft 3 of the golf club 2 whereby the cylindrical sleeve member 120 is slidably mounted on the shaft 3 of the golf club 2. The fastening means 130 comprises a threaded fastener 132 extending through one of the plurality of holes 128 and threadingly mating with one of the plurality of threaded holes 129.

The shaft contact means 140 comprises a button 141 protruding from each of the pair of axially aligned cavities 127 into the circular bore 120*c* of the cylindrical sleeve member 120. The button 141 has a concave contact surface 141*a*. A projection spring 142 is located within each of the pair of axially aligned cavities 127 and is positioned behind the button 141 whereby the projection spring 142 forces the concave contact surface 141*a* of the button 141 against the shaft 3 of the golf club 2. As such, the cylindrical sleeve member 120 is free to slidably travel along the length of the shaft 3 of the golf club 2 during a swing thereof.

A button retention means 150 is provided for retaining the button 141 within each of the pair of axially aligned cavities 127 while joining the pair of semi-cylindrical members 121 around the shaft 3 of the golf club 2. The button retention means 150 comprises a pin (not shown) inserted through a pin hole 152 provided in each of the pair of semi-cylindrical members 121 and along a groove 141*b* provided in the concave contact surface 141*a* of the button 141, whereby the pin compresses the button 141 into each of the pair of axially aligned cavities 127. The pin hole 152 extends from the semi-circular top surface 124 of each of the pair of semi-cylindrical members 121 to the semi-circular bottom surface 125, is provided adjacent the semi-circular groove 126 provided in each of the pair of semi-cylindrical members 121, and is axially aligned and contiguous with the pair of axially aligned cavities 127.

As best illustrated in FIG. 1 and FIGS. 9 through 11, it can be shown that an impact member 60 is provided around the shaft 3 of the golf club 2 adjacent the head 5 of the golf club 2. The impact member 60 is positioned intermediate the head 5 of the golf club 2 and the cylindrical sleeve member 20 so as to protect the head 5 of the golf club 2 from impact by the cylindrical sleeve member 20 as the cylindrical sleeve member 20 slidably travels along the length of the shaft 3 of the golf club 2 during a swing thereof. The impact member 60 has an impact surface 60*a* which receives the impact of the cylindrical sleeve member 20. The impact member 60 comprises a pair of semi-cylindrical impact members 62 each having a semi-circular groove 63 therein. The pair of semi-cylindrical impact members 62 are mateably joined to form a cylindrical impact member 61 having a circular bore 61*a* therethrough adapted to receive the shaft 3 of the golf club 2. The cylindrical impact member 61 is T-shaped wherein the cylindrical impact member 61 has a shoulder 61*b* adjacent the impact surface 60*a*. A joining means 64 is provided for joining the pair of semi-cylindrical impact members 62 around the shaft 3 of the golf club 2. An elastomer ring 70 is provided which may be placed around the shaft 3 of the golf club 2 adjacent the impact surface 60*a* of the impact member 60 so as to reduce the noise generated when the cylindrical sleeve member 20 contacts the impact surface 60*a* of the impact member 60.

In use, the pair of semi-cylindrical members 21 are mateably joined around the shaft 3 of the golf club 2 by the fastening means 30 to form the cylindrical sleeve member 20. The pin (not shown) is removed from the pin hole 52 such that the shaft contact means 40 is pressed against the shaft 3 of the golf club 2 by the projection spring 42. As such, the cylindrical sleeve member 20 is free to slidably travel along the length of the shaft 3 of the golf club 2. Before a user thereof swings the golf club 2, the Golf Swing Improvement Device 10 is slidably positioned adjacent the handle 4. While swinging the golf club 2, the cylindrical sleeve member 20 slidably travels down the shaft 3 and contacts the impact member 60. As such, a golfer can establish the "impact/power point" of his or her swing whereby during a correct swing of the golf club 2, the cylindrical sleeve member 20 will contact the impact member 60 at precisely the same time that the head 5 of the golf club 2 contacts a golf ball (not shown).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Golf Swing Improvement Device for use on a golf club having a shaft, a handle at one end of said shaft, and a head at an opposite end of said shaft, said device comprising:

a pair of semi-cylindrical members each having a planar surface, a convex surface, a semi-circular top surface, and a semi-circular bottom surface, said planar surface having a semi-circular groove therein extending from said semi-circular top surface to said semi-circular bottom surface, said semi-circular groove having a pair of axially aligned cavities therein;

a fastening means for mateably joining said pair of semi-cylindrical members to form a cylindrical sleeve member having a top surface and a bottom surface, and having a circular bore therethrough extending from said top surface to said bottom surface, said circular bore adapted to receive said shaft of said golf club, whereby said cylindrical sleeve member is slidably mounted on said shaft of said golf club; and a concentric shaft contact means provided within said circular bore of said cylindrical sleeve member for concentrically contacting and hugging said shaft of said golf club, whereby said cylindrical sleeve member is free to slidably travel concentrically along said shaft between said handle and said head of said golf club during a swing thereof, wherein said concentric shaft contact means comprises a ball bearing protruding from each of said pair of axially aligned cavities into said circular bore of said cylindrical sleeve member, and a projection spring located within each of said pair of axially aligned cavities and positioned behind said ball bearing whereby said projection spring maintains said ball bearing in continuous contact with said shaft of said golf club as said cylindrical sleeve member slidably travels concentrically therealong.

2. The Golf Swing Improvement Device of claim 1, wherein said semi-circular top surface and said semi-circular bottom surface of each of said pair of semi-cylindrical members each have a semi-annular groove therein, said semi-annular groove being undercut to form a semi-annular lip, said pair of semi-cylindrical members mateably joined to form an annular groove and an annular lip in each of said top surface and said bottom surface of said cylindrical sleeve member, and wherein said fastening means comprises a snap ring fitted within said annular groove and under said annular lip of each of said top surface and said bottom surface of said cylindrical sleeve member.

3. The Golf Swing Improvement Device of claim 1, further comprising:

a ball bearing retention means for retaining said ball bearing within each of said pair of axially aligned cavities while joining said pair of semi-cylindrical members around said shaft of said golf club.

4. The Golf Swing Improvement Device of claim 3, wherein each of said pair of semi-cylindrical members has a pin hole therethrough, said pin hole extending from said semi-circular top surface to said semi-circular bottom surface of each of said pair of semi-cylindrical members, said pin hole provided adjacent said semi-circular groove provided in each of said pair of semi-cylindrical members, said pin hole axially aligned and contiguous with said pair of axially aligned cavities, and wherein said ball bearing retention means comprises a pin inserted through said pin hole provided in each of said pair of semi-cylindrical members, whereby said pin compresses said ball into each of said pair of axially aligned cavities, whereby after said pair of semi-cylindrical members are joined around said shaft of said golf club said pin is removed from said pin hole and said projection spring forces said ball bearing against said shaft of golf club.

5. The Golf Swing Improvement Device of claim 1, wherein a first of said pair of semi-cylindrical members has a plurality of holes therethrough extending from said convex surface to said planar surface, and wherein a second of said pair of semi-cylindrical members has a plurality of threaded holes therethrough extending from said planar surface to said convex surface, said pair of semi-cylindrical members mateably joined such that one each of said plurality of holes is aligned with one each of said plurality of threaded holes, and wherein said fastening means comprises a threaded fastener extending through one of said plurality of holes and threadingly mating with one of said plurality of threaded holes.

6. The Golf Swing Improvement Device of claim 1, further comprising:

an impact member provided around said shaft of said golf club adjacent said head of said golf club, said impact member having an impact surface, said impact member positioned intermediate said head of said golf club and said cylindrical sleeve member so as to protect said head of said golf club from impact by said cylindrical sleeve member as said cylindrical sleeve member slidably travels along said shaft of said golf club during a swing thereof.

7. The Golf Swing Improvement Device of claim 6, wherein said impact member comprises:

a pair of semi-cylindrical impact members each having a semi-circular groove therein, and a joining means for mateably joining said pair of semi-cylindrical impact members to form a cylindrical impact member having a circular bore therethrough, said circular bore adapted to receive said shaft of said golf club.

8. The Golf Swing Improvement Device of claim 6, further comprising:

an elastomer ring provided around said shaft of said golf club adjacent said impact surface of said impact member so as to reduce the noise generated when said cylindrical sleeve member contacts said impact surface of said impact member.

9. A Golf Swing Improvement Device for use on a golf club having a shaft, a handle at one end of said shaft, and a head at an opposite end of said shaft, said device comprising:

a pair of semi-cylindrical members each having a planar surface, a convex surface, a semi-circular top surface, and a semi-circular bottom surface, said planar surface having a semi-circular groove therein extending from said semi-circular top surface to said semi-circular bottom surface, said semi-circular groove having a pair of axially aligned cavities therein;

a fastening means for mateably joining said pair of semi-cylindrical members to form a cylindrical sleeve member having a top surface and a bottom surface, and having a circular bore therethrough extending from said top surface to said bottom surface, said circular bore adapted to receive said shaft of said golf club, whereby said cylindrical sleeve member is slidably mounted on said shaft of said golf club; and a concentric shaft contact means provided within said circular bore of said cylindrical sleeve member for concentrically contacting and hugging said shaft of said golf club, whereby said cylindrical sleeve member is free to slidably travel concentrically along said shaft between said handle and said head of said golf club during a swing thereof, wherein said concentric shaft contact means comprises a button protruding from each of said pair of axially aligned cavities into said circular bore of said cylindrical sleeve member, said button having a concave contact surface, and a projection spring located within each of said pair of axially aligned cavities and positioned behind said button whereby said projection spring maintains said concave contact surface of said button in continuous contact with said shaft of said golf club as said cylindrical sleeve member slidably travels concentrically therealong.

10. The Golf Swing Improvement Device of claim 9, further comprising:

a button retention means for retaining said button within each of said pair of axially aligned cavities while joining said pair of semi-cylindrical members around said shaft of said golf club.

11. The Golf Swing Improvement Device of claim 10, wherein each of said pair of semi-cylindrical members has a pin hole therethrough, said pin hole extending from said semi-circular top surface to said semi-circular bottom surface of each of said pair of semi-cylindrical members, said pin hole provided adjacent said semi-circular groove provided in each of said pair of semi-cylindrical members, said pin hole axially aligned and contiguous with said pair of axially aligned cavities, and wherein said concave contact surface of said button has a groove therein, and wherein said button retention means comprises a pin inserted through said pin hole provided in each of said pair of semi-cylindrical members and along said groove provided in said concave contact surface of said button, whereby said pin compresses said button into each of said pair of axially aligned cavities, whereby after said pair of semi-cylindrical members are joined around said shaft of said golf club said pin is removed from said pin hole and said projection spring forces said concave contact surface of said button against said shaft of said golf club.

12. The Golf Swing Improvement Device of claim 9, wherein said semi-circular top surface and said semi-circular bottom surface of each of said pair of semi-cylindrical members each have a semi-annular groove therein, said semi-annular groove being undercut to form a semi-annular lip, said pair of semi-cylindrical members mateably joined to form an annular groove and an annular lip in each of said top surface and said bottom surface of said cylindrical sleeve member, and wherein said fastening means comprises a snap ring fitted within said annular groove and under said annular lip of each of said top surface and said bottom surface of said cylindrical sleeve member.

13. The Golf Swing Improvement Device of claim 9, wherein a first of said pair of semi-cylindrical members has a plurality of holes therethrough extending from said convex surface to said planar surface, and wherein a second of said pair of semi-cylindrical members has a plurality of threaded holes therethrough extending from said planar surface to said convex surface, said pair of semi-cylindrical members mateably joined such that one each of said plurality of holes is aligned with one each of said plurality of threaded holes, and wherein said fastening means comprises a threaded fastener extending through one of said plurality of holes and threadingly mating with one of said plurality of threaded holes.

14. The Golf Swing Improvement Device of claim 9, further comprising:

an impact member provided around said shaft of said golf club adjacent said head of said golf club, said impact member having an impact surface, said impact member positioned intermediate said head of said golf club and said cylindrical sleeve member so as to protect said head of said golf club from impact by said cylindrical sleeve member as said cylindrical sleeve member slidably travels along said shaft of said golf club during a swing thereof.

15. The Golf Swing Improvement Device of claim 14, wherein said impact member comprises:

a pair of semi-cylindrical impact members each having a semi-circular groove therein, and a joining means for mateably joining said pair of semi-cylindrical impact members to form a cylindrical impact member having a circular bore therethrough, said circular bore adapted to receive said shaft of said golf club.

16. The Golf Swing Improvement Device of claim 14, further comprising:

an elastomer ring provided around said shaft of said golf club adjacent said impact surface of said impact member so as to reduce the noise generated when said cylindrical sleeve member contacts said impact surface of said impact member.

17. A Golf Swing Improvement Device for use on a golf club having a shaft, a handle at one end of said shaft, and a head at an opposite end of said shaft, said device comprising:

a pair of semi-cylindrical members each having a planar surface, a convex surface, a semi-circular top surface, and a semi-circular bottom surface, said planar surface having a semi-circular groove therein extending from said semi-circular top surface to said semi-circular bottom surface, said semi-circular groove having at least one cavity therein;

a fastening means for mateably joining said pair of semi-cylindrical members to form a cylindrical sleeve member having a top surface and a bottom surface, and having a circular bore therethrough extending from said top surface to said bottom surface, said circular bore adapted to receive said shaft of said golf club whereby said cylindrical sleeve member is slidably mounted on said shaft of said golf club;

a shaft contact member protruding from said cavity into said circular bore of said cylindrical sleeve member, said shaft contact member contacting said shaft of said golf club as said cylindrical sleeve member slidably travels therealong; and a projection spring located within said cavity and positioned behind said shaft contact member whereby said projection spring maintains said shaft contact member in continuous contact with said shaft of said golf club as said cylindrical sleeve member slidably travels therealong.

18. The Golf Swing Improvement Device of claim 17, further comprising:

an impact member provided around said shaft of said golf club adjacent and above said head of said golf club whereby said impact member is positioned intermediate said head of said golf club and said cylindrical sleeve member, said impact member having an impact surface.

19. The Golf Swing Improvement Device of claim 18, wherein said impact member comprises:

a pair of semi-cylindrical impact members each having a semi-circular groove therein, and a joining means for mateably joining said pair of semi-cylindrical impact members to form a cylindrical impact member having a circular bore therethrough, said circular bore adapted to receive said shaft of said golf club.

20. The golf Swing Improvement Device of claim 18, further comprising:

an elastomer ring provide around said shaft of of said golf club adjacent and above said impact surface of said impact member whereby said elastomer ring is positioned intermediate said impact member and said cylindrical sleeve member.

* * * * *